US006152092A

United States Patent [19]

Andreasson et al.

[11] Patent Number: 6,152,092

[45] Date of Patent: Nov. 28, 2000

[54] INTERNAL COMBUSTION ENGINE

[75] Inventors: Bo Andreasson, Ytterby; Roy Ekdahl, Floda; Hans Ström, Kode; Ulf Svensson, deceased, late of Lerum; by Gunnel Maria Vilhelmina Svensson, legal representative; by Hubert Malte Svensson, legal representative, both of Trollhättan, all of Sweden

[73] Assignee: Aktiebolaget Electrolux, Stockholm, Sweden

[21] Appl. No.: 09/297,908

[22] PCT Filed: Nov. 14, 1997

[86] PCT No.: PCT/SE97/01916

§ 371 Date: Jun. 21, 1999

§ 102(e) Date: Jun. 21, 1999

[87] PCT Pub. No.: WO98/22703

PCT Pub. Date: May 28, 1998

[30] Foreign Application Priority Data

Nov. 15, 1996 [SE] Sweden ..... 9604236

[51] Int. Cl.[7] ..... F02B 33/04

[52] U.S. Cl. ..... 123/65 R; 123/65 EM; 123/65 PE

[58] Field of Search ..... 123/65 R, 65 EM, 123/65 PE

[56] References Cited

U.S. PATENT DOCUMENTS 941,376 11/1909 Lucas .
2,246,446 6/1941 Kylen .
4,682,571 7/1987 Kaufman et al. .
4,934,345 6/1990 Fukuoka et al. .
5,794,605 8/1998 Kato ..... 123/65 R

FOREIGN PATENT DOCUMENTS 564099 12/1923 France .
363519 9/1921 Germany .
385515 2/1922 Germany .
810 200 5/1951 Germany .
26 43 242 3/1978 Germany .
26 43 240 4/1978 Germany .

*Primary Examiner*—Marguerite McMahon
*Attorney, Agent, or Firm*—Pearne & Gordon LLP

[57] ABSTRACT

Crankcase scavenged internal combustion engine (1) of two-stroke type, intended for a working tool, preferably a chain saw or a trimmer, and provided with a light-weight and compact muffler (2). The engine is arranged with a particularly high crankcase compression created in that at least one filling (3, 4, 5, 6) is placed into the compression area (7) under the engine piston (8) in form of a filled balance (3) and/or a piston filling (4) and/or a piston washer (5) and/or a stationary filling (6), at the same time as the engine is provided with an especially strong throttling created in the engine's exhaust side, i.e. in its exhaust port (9) and/or in a possible exhaust duct (10) and/or in the muffler (2).

19 Claims, 3 Drawing Sheets

INTERNAL COMBUSTION ENGINE

TECHNICAL FIELD

The subject invention refers to a crankcase scavenged internal combustion engine of two-stroke type, intended for a working tool, preferably a chain saw or a trimmer, and provided with a light-weight and compact muffler.

BACKGROUND OF THE INVENTION

For working tools run by internal combustion engines generally two-stroke engines are used, mainly due to their low weight and simple design. Also, the crankcase scavenging enables a lubrication system independent of position, in which the engine is lubricated by oil which is added to the air-fuel mixture scavenged through the crankcase. The all-position lubrication system is necessary e.g. for chain saws since they are to be used in a lot of different working positions. Two-stroke engines for mopeds and motor-cycles generally have a so called tuned exhaust system. Reflecting pressure pulses from the exhaust system will press scavenging gases back into the cylinder so that the engine's scavenging losses are reduced. In total this means that both the power output and fuel consumption can be improved in comparison with a non-tuned exhaust system. However, in order to function the tuning requires very large lengthes of pipe in the exhaust duct. Such a muffler for a chain saw would be at least half a meter long and consist of a first conically expanding duct section by approximately 8 degrees, and a second conically narrowing section by approximately 12 degrees. Thereafter an absorption muffler should be connected in order to reach reasonable sound-levels. As mentioned above such a muffler is built on reflecting pressure pulses as well as a low total fall of pressure. Regarding working tools it has turned out that such a muffler will be far too large and heavy. This even if the pipe system is provided with a lot of curves. For, a working tool must be very light-weight, compact and handy in order to serve its purpose. Consequently, tuned exhaust systems are normally not used for working tools. Instead they have light-weight and compact mufflers in which the sound mainly is damped by throttling in the muffler. A larger cylinder volume is used to reach the preferable effect. Owing to the fact that there are great differences between the lay out of two-stroke engines with tuned exhaust systems and without tuned exhaust systems, it is difficult to transfer experiences from one area to another.

A well-known problem with two-stroke engines is their relatively high fuel consumption caused by high scavenging losses, i.e. scavenging gases which go straight out into the exhaust system. This also results in high emissions, especially from hyrdocarbons. As mentioned above, the difficulties to overcome this problem are especially big for two-stroke engines with light-weight and compact mufflers, i.e. with non-tuned exhaust systems. The high extent of emissions from hydrocarbons also results in certain problems when using a muffler with catalytic conversion. For, the very high energy of the exhaust gases leads to a very high heat generation in the catalytic converter as well as in the surrounding muffler. This high extent of heat generation could mean that the conversion ratio in the catalytic converter must be kept down. Consequently, the high scavenging losses would increase the fuel consumption at the same time as they could complicate a cooperation with an exhaust catalytic converter.

PURPOSE OF THE INVENTION

The purpose of the subject invention is to substantially reduce the above outlined problems for a crankcase scavenged internal combustion engine of two-stroke type, provided with a light-weight and compact muffler.

SUMMARY OF THE INVENTION

The above mentioned purpose is achieved in an arrangement, in accordance with the invention, having the characteristics appearing from the appended claims.

The crankcase scavenged internal combustion engine in accordance with the invention is thus essentially characterized in that the engine is arranged with a particularly high crankcase compression created in that at least one filling is placed in the compression area under the engine piston in form of a filled balance and/or a piston filling and/or a piston washer and/or a stationary filling, at the same time as the engine is provided with a particularly strong throttling in the engine's exhaust side, i.e. in its exhaust port and/or in a possible exhaust duct and/or in the muffler. Two steps are thus taken at the same time. The first one is to create a particularly high crankcase compression by way of one or several fillings in the compression area under the engine piston. Testings of using this first step alone have lead to completely unacceptable engine performance, and have therefore not been useful. The second step is to create a particularly strong throttling in the engine's exhaust side. This throttling is very strong and lies completely outside the throttling variations which are used in normal tuning of this type of engine. Such a throttling alone would lead to an unacceptably low engine power, almost half of the engine power. However, with a combination of these two steps engines have been created providing a reduced fuel consumption by approximately 10–15 percent and reduced exhaust emissions regarding hydrocarbons by nearly 40 percent. This has been achieved with a for this type of engine acceptable shape of the torque curve and with retained power. Furthermore, the reduced scavenging losses mean that this engine can cooperate better with catalytic exhaust conversion than a conventional engine can. Further characteristics and advantages of the invention will become more apparent from the detailed description of preferred embodiments and with the support of the drawing figures.

BRIEF DESCRIPTION OF THE DRAWING

The invention will be described in closer detail in the following by way of various embodiments thereof with reference to the accompanying drawing, in which the same numeral references in the different figures state one another's corresponding parts.

In the schematic FIG. 1 numeral reference 1 designates an internal combustion engine of two-stroke type. It is crankcase scavenged, i.e. a mixture 12 of air 13 and fuel 14 from a carburetor 15, or a fuel injection system, is supplied to the engine crankcase. From there the mixture 12 is supplied through one or several scavenging ducts 16 up to the engine's combustion chamber 17. This is provided with a spark plug, which ignites the compressed gas mixture. Exhaust gases 18 lead out through exhaust port 9 and through a muffler 2. The engine has a piston 19, which via a piston rod 20 is mounted into a crank part 21 with a counterweight. In this manner the crankshaft is rotatably driven. All this is entirely conventional for an internal combustion engine and will therefore not be further examined. In FIG. 1 the piston 19 holds an intermediate position where a flow becomes possible both through inlet port 22, exhaust port 9 and through the scavenging duct 16. The mouth of the inlet duct 11 in the cylinder is called inlet port 22. Consequently, in this manner the inlet duct 11 will be closed by the piston 19.

In a closer view of the intake system we can see that the air 13, via an inlet 24, is flowing into a filter cover 23 provided with a filter 25. When passing the filter 25 the intake air 13 will be cleaned. Also, the intake air has often already been cleaned at a previous step before it reaches the inlet 24, usually via centrifugal cleaning or deflection cleaning. From the filter cover 23 the air 13 is flowing into the inlet duct 11. The cross section area in the direction of flow is abruptly changed by the changeover from filter cover 23 to the inlet duct 11. The length L of the inlet duct 11 from the abrupt change of area to the inlet port 22 affects the so called Helmholz resonance frequency. The resonance frequency is essentially determined by the relation between the length L of the inlet duct and the crankcase volume, which is well reflected by the cylinder stroke S. The resonance frequency corresponds to a speed, at which the intake feeding is as efficient as possible. At this speed the engine reaches its point of maximum torque. At constant crankcase volume the engine speed at maximum torque will to be reduced with increasing length L of the inlet duct 11, while this engine speed will be increased with decreasing length L. The crankcase volume is the volume located in the crankcase and under the piston 19. On the whole it is proportional to the cylinder stroke S, which for the sake of clarity has been marked in the figure in a horizontal direction. The crank part 21 with counterweight is partly filling up the volume of the crankcase itself In FIG. 1 the volume in the very crankcase is mostly filled up by a filled balance 3. In the shown example this balance is filling up the space between the crank part 21 and a circle 26 with a centre in the crankshaft centre. In the figure this area is shaded. The figure also shows a stationary filling 6. This is located above the crank part 21 and is mounted to the cylinder wall 27 by means of one or several stay rods 28. In the piston are made apartures for these stay rods, but for the sake of clarity they are not shown here. The stationary part 6 is thus standing still and fills up the volume between the to and fro moving piston 19 and the rotating crank part 21. Obviously, the stationary filling 6 is so designed that not any part of the piston can hit the filling when the piston is in its lowest position, i.e. most adjacent the crankshaft centre. Both of the fillings can be used on their own or in combination with each other. In FIG. 2 two further different types of crankcase fillings have been added. These are located in the piston 19 and can not be used in combination with the shown stationary filling 6. The fillings 5 and 4 are therefore shown by dash-dotted lines. In the shown example the fillings 4 and 5 could simply hit the stationary filling 6 when the piston is moving further downwards. In FIG. 2 the different fillings are shown in a pedagogic way to become more apparent. In a real case one or several of the shown fillings could be combined with each other by an adjustment of the space they need. From a technical point of view it would be most likely to use only the filled balance 3, just as shown in FIG. 1, but without the filling 6. The filled balance 3 is preferably composed of filling bodies 3 which fill up the space between the crank part 21 and the surrounding crankcase wall, of course with a suitable play. In order to as much as possible reduce the filling bodies' influence on the balancing of the crankshaft, they are preferably produced from light-weight materials, such as fibreglass reinforced plastic, or light metal, such as aluminium or magnesium. The mounting of the filling bodies can be made in many different ways. A particularly simple variant is that the filling bodies are arranged in a bowl-shaped holder, which exhibits a ring-shaped peripheral wall intended to surround the crank part 21, and an end wall with a centre hole intended for reception of the crankshaft. This device is simple to mount in the engine and would therefore be well suited for rational serial production. A bowl-shaped holder is pressed on the crank part from each side, so that a filled balance is easily created. The crankshaft bearings are mounted in a normal,.way, i.e. on each side of the bowl-shaped holder respectively. The bowl-shaped holder with outer diameter 26 is preferably made of metal, such as steel plate or light metal, or reinforced plastics, such as fibreglass reinforced polyamide. The holder has such a diameter, with outer periphery 26, that it with suitable fit surrounds the crank part 21. As an alternative the filling bodies and the holder can be manufactured in one piece, either from light metal, for example by means of die casting, or from plastic materials, as mentioned above, by means of injection-moulding or vacuum-moulding. Filled balances 3, i.e. fully or partly filled, can also be created in that the crank part 21 is moulded or cast into, or moulded on by, a light-weight material, such as plastic or aluminium. The casting/moulding procedure can also include cavities in the material in order to reduce the weight, and can for instance be made by injection-moulding in plastic or die casting in aluminium. The made experiences indicate that at least one filling shall be placed into the compression area in form of an essentially completely filled balance 3, either alone or in combination with at least any one of piston filling 4, piston washer 5 or stationary filling 6. By this combination the crankcase compression can be increased even further.

Figure 1:
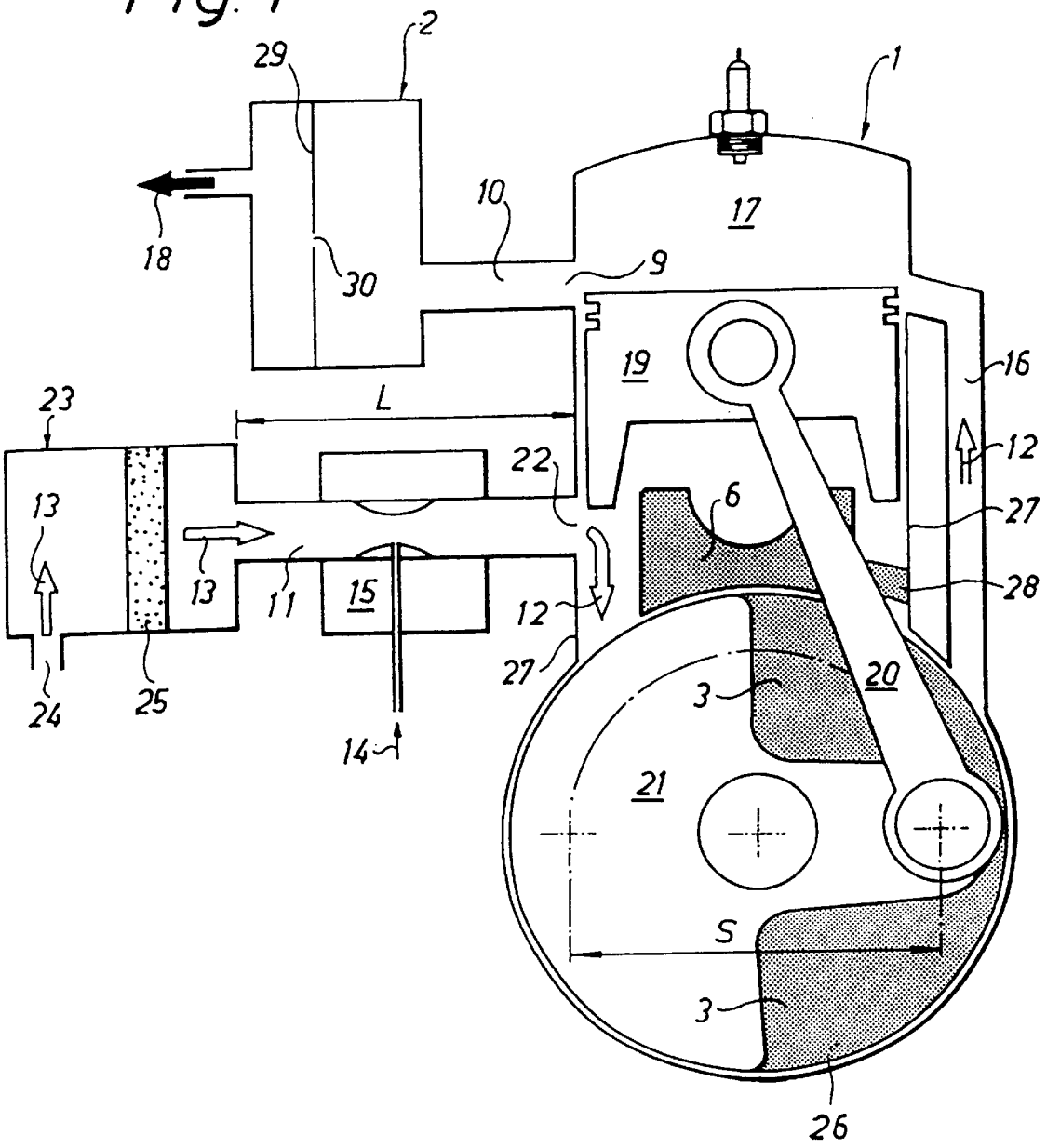
FIG. 1 illustrates schematically a crankcase scavenged internal combustion engine of two-stroke type, in accordance with the invention. It is provided with two different types of crankcase fillings.
Figure 2:
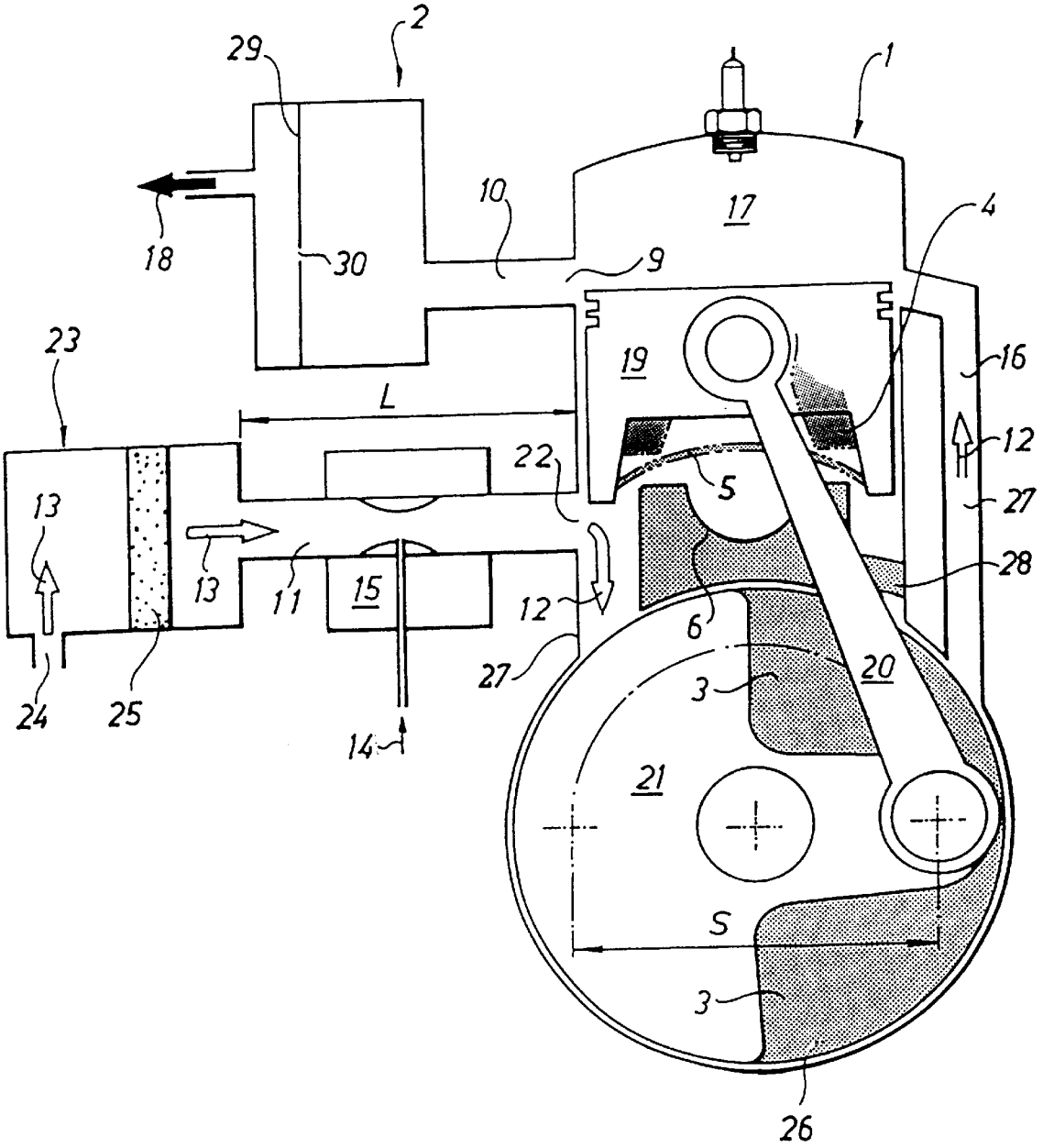
FIG. 2 shows the engine in accordance with FIG. 1, but provided with two further different types of crankcase fillings.

The filling 6 is characteristic in that it is stationary. It means that its weight does not affect the movement of the piston or the crankshaft, and therefore its weight is not as critical as the other fillings' weight. Naturally it shall nevertheless be light-weight considering the desired low total weight of the engine. For the sake of clarity the filling 6 in FIG. 1 is shown somewhat smaller than what is preferable from a view of efficiency. The cooling of the piston might not necessarily be affected negatively by the filling 6 since scavenging gases 12 could still reach the piston's inner parts in order to cool these down. Possibly the cooling of the piston could even be affected positively by the filling 6. For, when the piston 19 is in its lower position radiant heat can pass over to the filling 6 and then be lead via the stay rods 28 further on to cooler parts of the engine. The filling 6 could for instance be made of die cast light metal with integrated stay rods 28, which then at suitable spots are mounted to the cylinder wall 27. The the piston filling 4 in FIG. 2 is simply a filling of certain parts of the inner cavity of the piston. Consideration must of course be taken to the movement of the piston rod 20. In principle the total inner space of the piston could be filled up, apart from a slit intended for the movement of the piston rod. Preferably a very light-weight but at the same time heat resistant material could be used for the filling. Nor does the filling have to be massive but it can consist of an outer shell with enclosed cavities. A disadvantage of the piston filling 4 is that it could easily lead to a reduced cooling of the piston, that could increase the risk of engine seizure. Also, the weight of the filling increases the weight of the piston, which is disadvantageous.

The filling 5 can be compared to a lid, which is placed on the underside of the piston. Obviously, there is a slit in the lid which permits the piston rod 20 to be angled forwards and backwards through the filling 5. This slit can be provided with more or less sophisticated sealings, or, it could be entirely unsealed. In those cases the slit is not sealed there can be some leakage in and out through the slit. This means that the filling 5, or the piston washer 5, will get a dynamic character, which separates it from the other fillings. In the shown example the piston washer 5 has a single-curved vaulting, which fits together with the shape of the crank part 21. When the filling 5 is used in this design, then the filling 6 is not used. But obviously the filling 5 can be placed higher up in the piston and the filling 6 can be reduced, so that they actually can be used at the same time. The filling 5 could also be used together with the filling 4 even if it perhaps would be more obvious to use each one individually. The piston washer is preferably made of a light-weight and strong metallic or plastic material. It could result in a reduced cooling of the piston.

What is common for the shown fillings 3, 4, 5 and 6 is that they either on their own or together can create a substantial increase of the crankcase compression. The most suitable filling, estimated from a practical point of view, should be a filled balance 3. Hereby an essentially reduced crankcase volume, which results in a particularly high crankcase compression, is achieved in a relatively simple way. In case this arrangement is applied on an engine of this kind, i.e. with a small and compact muffler, it would result in a big displacement of the engine's moment curve. The engine is losing torque at lower speed and gets higher torque at higher speed. The torque curve is simply being displaced towards higher speed. At the same time the overspeed value is increasing. This means that the measure can not be taken alone due to the fact that the engine then gets a completely undesired character. As far as the applicant know such an engine has not earlier been presented.

Figure 3:
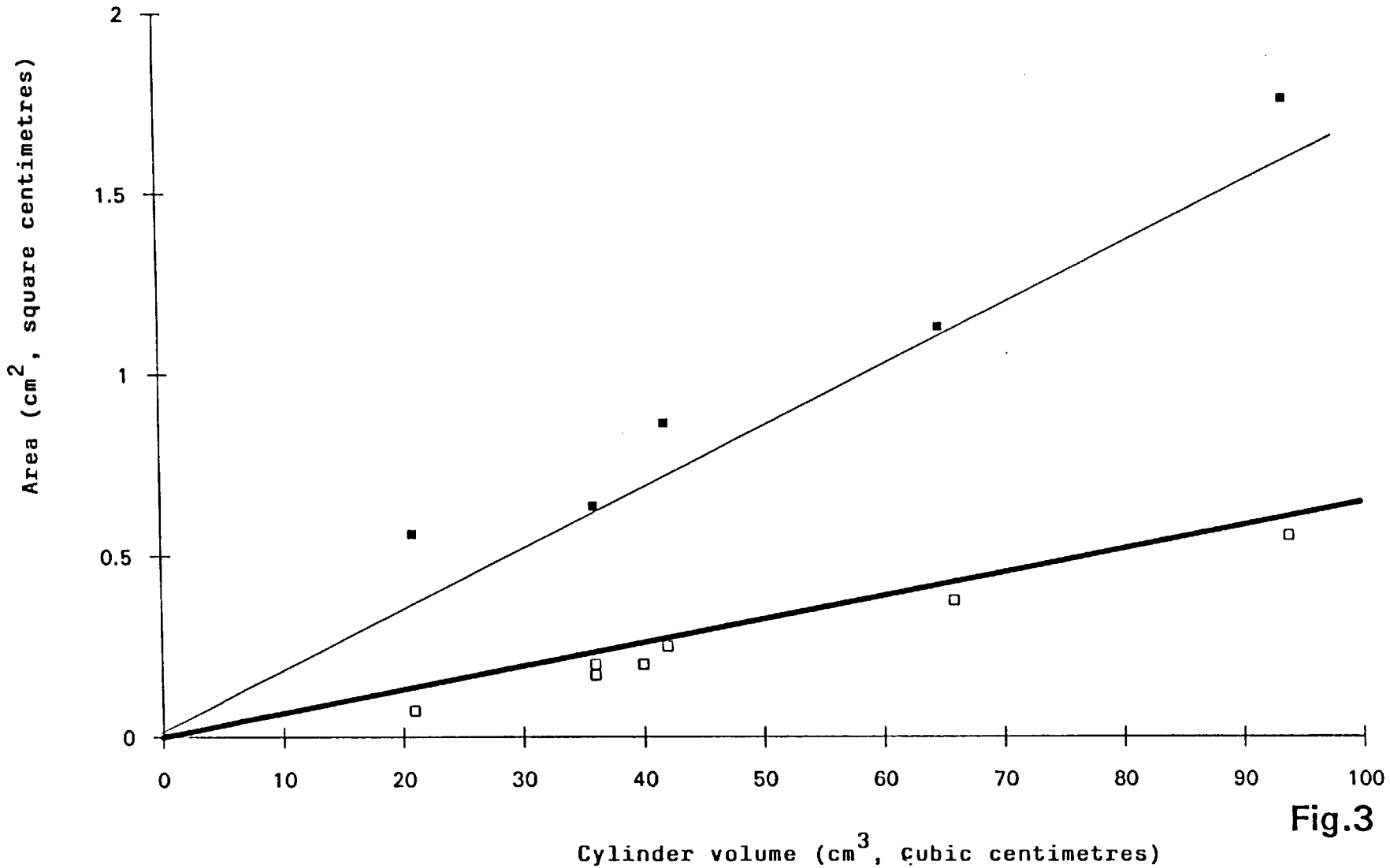
FIG. 3 shows a diagram with a throttle area in the engine's exhaust side as a function of the engine cylinder volume. From the diagram a number of engines in accordance with the invention can be compared with corresponding conventional engines.

The engine's exhaust side comprises an exhaust port 9 followed by an exhaust duct 10, which leads to a muffler 2. The muffler 2 is often directly mounted to the exhaust port 9 and if so the exhaust duct 10 is excluded. Since long time light-weight and compact mufflers 2 have been used for working tools. It means that so called tuned exhaust systems will be out of question since they require very large length of pipe, in this case approximately 450 mm, plus a secondary mounted muffler, in order to reach an acceptable sound level. This leads to an exhaust system which is far too large and heavy to be used. In itself such an exhaust system enables an increase of engine power, so that a smaller cylinder could be used. But this advantage is quite unsatisfactory for creating a totally seen light-weight, compact and handy working tool. The light-weight and compact mufflers 2 which are used within the field are instead built on the fact that the sound is mainly damped by throttling in the muffler. A stronger throttling leads to reduced power. Often a dominating throttling in the muffler is used. In the figure this is marked as throttling 30 in a mounted baffle 29 in the muffler. FIG. 3 shows a diagram where the area in square centimetres in the dominating throttling 30 has been marked as a function of the engine cylinder volume for engines between 20 and approximately 100 cc. Above the upper straight line there is a number of conventional engines marked out. As appears from the diagram the points spread relatively little, and they are all lying above the marked line. Quite simply the fact is that points located at a high level in relation to the line give more power but bad noise reduction, while points located at a low level give the opposite result. Why no points are located under the marked line is entirely due to the fact that this would lead to an unacceptably low power in relation to the cylinder volume.

An idea has been born to combine the two each one on their own completely unacceptable measures of increasing the crankcase compression substantially, and of a substantial increase of the throttling in the exhaust system. Testings have therefore been made with engines provided with filled balances 3 in combination with a particularly strong throttling created in the engine's exhaust side. None of the engines have exhaust catalytic converter. The throttling has been placed in the muffler as a dominating throttling 30. The throttle area in the throttling 30 has been marked for engines corresponding to the conventional ones in the diagram. As appears from the diagram the throttle areas are only a fraction of those used in the conventional engine. In all cases the areas are absolutely less than half as large as those used in corresponding conventional engines. In combination with the filled balance 3 this has lead to interesting improvements of the engine performance. Without combination with the filled balance the throttling should instead have lead to an unacceptably low power, down to half of the power of the conventional engine. For, the test results show that with retained power the engine's fuel consumption can be reduced by 10–5 percent and the exhaust emissions can be reduced by up to 40 percent, as regards hydrocarbons. These results have been achieved for a number of different engines with a cylinder volume of between 20 to approximately 100 cc, according to FIG. 3. At the same time the engine's maximum speed as well as overspeed are both lying within acceptable speed ranges. These speed ranges can also be somewhat affected by a prolonging of the inlet duct's length L, and thereby the Helmholz resonance goes down. This is preferably achieved in that the engine's inlet duct 11 has a length longer than 3,5 times the cylinder stroke S, preferably longer than 4 times the cylinder stroke.

The explanation of the good result must be ascribed to the fact that the more effective pumping in the scavenging system together with a stronger throttling have managed to reduce the losses of unburned hydrocarbons out through the exhaust port 9. The more exact mechanism behind this matter of fact is elusive. The experiences earlier known from both measures, i.e. to utilize fillings in the crankcase and to throttle strongly, pointed to the fact that one measure increases the power essentially and the other measure reduces the power essentially. On the other hand there were no indications whatsoever that a combination of both measures would lead to reduced fuel consumption and reduced exhaust emissions at unchanged power. One by one the measures in question lead to normally seen unacceptable engine performance. The other fillings 4, 5, 6, which also give a particularly high crankcase compression, should also be able to give the same advantageous effect as achieved with the filled balance 3. This is based on the opinion that high crankcase compression is the most important factor behind a more effective pumping in the scavenging system. However, at the same time the efficiency is no doubt also affected by the flow in the crankcase, and consequently by different fillings 3–6 as well as combinations of fillings. As appears from the FIGS. 1–3 the throttling at the engine's exhaust side is mainly located in a single throttling in the muffler, and its area expressed in cubic centimetres is less than 0.01 times the engine cylinder volume expressed in cubic centimetres, preferably less than 0.008 times the engine cylinder volume. The denomination for surface and volume could also be squareinch and cubicinch respectively. In this case the above mentioned relations should instead be 0.025 and 0.020 respectively. The relations 0.01 and 0.008 become apparent by analyzing FIG. 3. It has proved to be advantageous to create the throttling as a strong local throttling 30 in the muffler. But obviously it could also be located at the outlet or inlet of the muffler. To be able to provide the best effect the throttling should have a short extension in its longitudinal direction. The throttling could also be located in a possible exhaust duct 10 or in the engine's exhaust port 9. The main consideration to achieve the function is to build up a substantial back pressure on the exhaust side. This can be created in a substantially dominating throttling 30 or in a number of cooperating throttlings. The throttling at the engine's exhaust side shall have an equivalent throttle area expressed in square centimetres, which is less than 0.01 times the engine cylinder volume expressed in cubic centimetres, preferably less than 0.008 times the engine cylinder volume. The denomination for surface and volume could also be square inch and cubicinch respectively. In this case the above mentioned relations would instead be 0.025 and 0.020 respectively. The throttling effect can also be created in that the exhaust port 9 is given such a short height in the piston's working direction that the exhaust gases could hardly manage to get out. Consequently, a short exhaust period will also lead to a certain throttling effect. As a standard of the size of the throttling in the engine's exhaust side preferably the mean back pressure is used, which can be measured on the exhaust side. Normally this measuring is made in the muffler 2 upstreams the dominating throttling 30. But obviously the mean back pressure can be measured further upstreams in a possible exhaust duct 10 or in/at the exhaust port 9 proper. The mean back pressure is measured as a mean value formation of the pressure over each engine revolution respectively. In those cases the dominating throttling is lying in the exhaust port 9 itself, the pressure measuring should be made at the inlet of the port 9 in the cylinder. The advantage of using the mean back pressure as a standard of the throttling effect is that consideration is then taken to the throttling effect no matter how this is created. For, testings made both with and without catalytic converter show that the catalytic converter helps to build up a back pressure. The main reason therefore is that the heating in the catalytic converter will increase the exhaust volumes. Without a catalytic converter this corresponds to a nearly 15 per cents decrease of the throttle area at relevant temperatures. The experiences made from the testing results point to the fact that the throttling in the engine's exhaust side shall be so strong that the maximum mean back pressure on the exhaust side is larger than 13 kPa, preferably larger than 20 kPa. Normal engines have a mean back pressure within the range of 3–10 kPa and therefore this means a substantial increase. The maximum mean back pressure occurs at full throttle operation and at the speed that corresponds to the maximum engine power.

The engine crankcase compression ratio is the relation between the maximal volume in the crankcase under the piston and the minimal volume. Obviously the volume is maximal at the top dead centre and minimal at the bottom dead centre. At the testings mentioned above, according to FIG. 3, the crankcase compression ratio was increased by approximately 13%, from haughtily 1.4 to haughtily 1.6. The increased compression ratio varies from 1.53 to 1.68. The increase can seem small, but nevertheless, as mentioned above, it affects the engine performance substantially. The crankcase compression ratio should preferably be larger than 1.5, preferably larger than 1.6 by utilizing the invention.

The muffler 2 can also be provided with catalytic conversion. This can be arranged in many different ways, e.g. a catalytic converter element can be placed into a flow passage in the muffler, or an intermediate section, such as the baffle 29, can be provided with a number of small apertures through which the exhaust gases must pass by. Then the baffle 29 is preferably either completely or partly coated with a catalytic layer. The total throttle area in the apertures is so adapted that it corresponds to a suitable and equivalent throttle area in the single throttling 30. The area in the apertures is preferably so determined that the mean back pressure becomes larger than 20 kPa. The improvement of the basic engine's performance becomes particularly advantageous when using catalytic conversion. For, one problem with conventional engines of two-stroke type is the high extent of unburned hydrocarbons reaching the muffler and its catalytic converter. For, the high extent of unburned hydrocarbons leads to a very substantial temperature development in the catalytic converter. This temperature development could be a problem, on the one hand for the catalytic converter element itself and on the other hand also for the muffler due to the heating of its housing part. Consequently, as a result of the more efficient combustion created by the invention the exhaust gases will have a lower content of unburned hydrocarbons, which is considerably facilitating for the catalytic converter at the same time as the fuel consumption is decreased. In many cases the conversion ratio in the catalytic converter must be limited considering the risk factors involved with an extreme heating of the catalytic converter. This means that if the same amount of exhaust gases are burnt in the catalytic converter in the improved engine in accordance with the invention, the exhaust gases will become cleaner. As an alternative a more simple catalytic converter could be used burning less than the converter of a conventional engine, at the same time as the final result would still be the same amount of exhaust gases. Obviously, the advantage in this case would be, on the one hand a more simple catalytic converter, and on the other hand less heat development in the catalytic converter as well as less fuel consumption. The invention could also be used for a crankcase scavenged two-stroke engine with a direct injection into the cylinder, or injection into the scavenging ducts. Since the injection often starts before the exhaust port has been closed the invention could also in these cases contribute to less scavenging losses, i.e. less fuel consumption and less exhaust emissions.

What is claimed is:

1. Crankcase scavenged internal combustion engine (1) of two-stroke type, intended for a working tool, and provided with a light-weight and compact muffler (2), characterized in that the engine is arranged with a particularly high crankcase compression created in that at least one filling (3, 4, 5, 6) is placed in the compression area (7) under the engine piston (8), said filling being selected from the group consisting of a filled balance (3), a piston filling (4), a piston washer (5), and a stationary filling (6); and in that the engine is provided with a particularly strong throttling provided by a restriction in the engine's exhaust side.

2. Crankcase scavenged internal combustion engine (1) in accordance with claim 1, characterized in that at least one filling is placed in the compression area in form of an essentially completely filled balance (3), either alone or in combination with at least any one of a piston filling (4), a piston washer (5) or a stationary filling (6).

3. Crankcase scavenged internal combustion engine (1) in accordance with claim 1 or 2, characterized in that the throttling in the engine's exhaust side is so strong that the maximum mean back pressure on the exhaust side is larger than 13 kPa.

4. Crankcase scavenged internal combustion engine (1) in accordance with claim 1, characterized in that the crankcase compression ratio is larger than 1.5.

5. Crankcase scavenged internal combustion engine (1) in accordance with claim 1, characterized in that the throttling in the engine's exhaust side has a total throttle area expressed in square centimetres, which is less than 0.01 times the engine cylinder volume expressed in cubic centimetres.

6. Crankcase scavenged internal combustion engine (1) in accordance with claim 1, characterized in that the throttling in the engine's exhaust side has a total throttle area expressed in square inches, which is less than 0.025 times the engine cylinder volume expressed in cubic inches.

7. Crankcase scavenged internal combustion engine (1) in accordance with claim 1, characterized in that the throttling in the engine's exhaust side is mainly located in a single throttling in the muffler (2), and the engine's exhaust side having a total throttle area expressed in square centimetres which is less than 0.01 times the engine cylinder volume expressed in cubic centimetres.

8. Crankcase scavenged internal combustion engine (1) in accordance with claim 1, characterized in that the throttling in the engine's exhaust side is mainly located in a single throttling in the muffler (2), and its area expressed in square inches is less than 0.025 times the engine cylinder volume expressed in cubic inches.

9. Crankcase scavenged internal combustion engine (1) in accordance with claim 1, characterized in that the engine's inlet duct (11) has a length (L) longer than 3.5 times the cylinder stroke (S).

10. Crankcase scavenged internal combustion engine (1) in accordance with claim 1, characterized in that the muffler (2) is provided with catalytic exhaust conversion.

11. Crankcase scavenged internal combustion engine (1) in accordance with claim 1, characterized in that filled balances (3) are created in that the crank part (21) is molded or cast into, or molded on by, a light-weight material, such as plastic or aluminum.

12. Crankcase scavenged internal combustion engine (1) in accordance with claim 1 or 2, characterized in that the throttling in the engine's exhaust side is so strong that the maximum mean back pressure on the exhaust side is larger than 20 kPa.

13. Crankcase scavenged internal combustion engine (1) in accordance with claim 1, characterized in that the crankcase compression ratio is larger than 1.6.

14. Crankcase scavenged internal combustion engine (1) in accordance with claim 1, characterized in that the throttling in the engine's exhaust side has a total throttle area expressed in square centimeters, which is less than 0.008 times the engine cylinder volume expressed in cubic centimeters.

15. Crankcase scavenged internal combustion engine (1) in accordance with claim 1, characterized in that the throttling in the engine's exhaust side has a total throttle area expressed in square inches, which is less than 0.020 times the engine cylinder volume expressed in cubic inches.

16. Crankcase scavenged internal combustion engine (1) in accordance with claim 1, characterized in that the throttling in the engine's exhaust side is mainly located in a single throttling in the muffler (2), and the engine's exhaust side having a total throttle area expressed in square centimeters which is less than 0.008 times the engine cylinder volume expressed in cubic centimetres.

17. Crankcase scavenged internal combustion engine (1) in accordance with claim 1, characterized in that the throttling in the engine's exhaust side is mainly located in a single throttling in the muffler (2), and the engine's exhaust side having a total throttle area expressed in square inches which is less than 0.02 times the engine cylinder volume expressed in cubic inches.

18. Crankcase scavenged internal combustion engine (1) in accordance with claim 1, characterized in that the engine's inlet duct (11) has a length (L) longer than 4 times the cylinder stroke (S).

19. Crankcase scavenged internal combustion engine (1) in accordance with claim 1, wherein said restriction is provided by baffle having a small opening, said baffle being located within said light-weight and compact muffler.

* * * * *